US010369416B2

(12) United States Patent
Huang

(10) Patent No.: US 10,369,416 B2
(45) Date of Patent: Aug. 6, 2019

(54) RESISTANCE DEVICE AND EXERCISE EQUIPMENT HAVING THE SAME

(71) Applicant: FITEK FITNESS PRODUCTS INC., Chiayi County (TW)

(72) Inventor: Wan-Fu Huang, Chiayi County (TW)

(73) Assignee: FITEK FITNESS PRODUCTS INC., Chiayi County (TW)

( * ) Notice: Subject to any disclaimer, the term of this patent is extended or adjusted under 35 U.S.C. 154(b) by 112 days.

(21) Appl. No.: 15/815,109

(22) Filed: Nov. 16, 2017

(65) Prior Publication Data

US 2018/0369643 A1 Dec. 27, 2018

(30) Foreign Application Priority Data

Jun. 27, 2017 (TW) ..... 106209367 U

(51) Int. Cl.
*A63B 22/06* (2006.01)
*A63B 24/00* (2006.01)
*A63B 21/015* (2006.01)

(52) U.S. Cl.
CPC ..... *A63B 24/0087* (2013.01); *A63B 21/015* (2013.01); *A63B 22/0605* (2013.01); *A63B 2024/0093* (2013.01)

(58) Field of Classification Search
CPC ..... A63B 22/06; A63B 21/00; A63B 21/01; A63B 21/00069; A63B 2225/09; A63B 2225/093; A63B 21/02; A63B 2071/0081
See application file for complete search history.

(56) References Cited

U.S. PATENT DOCUMENTS 4,824,104 A * 4/1989 Bloch ..... A63B 21/015 188/134
5,031,901 A * 7/1991 Saarinen ..... A63B 21/0051 310/191
5,088,748 A * 2/1992 Koselka ..... A63C 17/1436 188/29
5,352,169 A * 10/1994 Eschenbach ..... A63B 22/0664 482/51
5,374,227 A * 12/1994 Webb ..... A63B 21/157 482/51
5,466,203 A * 11/1995 Chen ..... A63B 21/0051 482/57
5,749,807 A * 5/1998 Webb ..... A63B 21/157 482/52
5,810,696 A * 9/1998 Webb ..... A63B 21/00845 482/52

(Continued)

*Primary Examiner* — Garrett K Atkinson
(74) *Attorney, Agent, or Firm* — Muncy, Geissler, Olds & Lowe, P.C.

(57) ABSTRACT

An exercise equipment includes a torque generating mechanism, and a resistance adjusting mechanism including a resistance applying unit that includes a fixed seat, a contact member pivotally connected to the fixed seat, a first link pivotally connected to the fixed seat, and a second link pivotally connected between the first link and contact member, a resistance sensing unit that includes a magnetic member mounted to the second link and movable relative to the first link, and a Hall sensing module mounted to the first link, and disposed for outputting a sensing signal generated by magnetic field variation induced by a relative movement between the Hall sensing module and the magnetic member.

10 Claims, 6 Drawing Sheets

(56) References Cited

U.S. PATENT DOCUMENTS 6,293,376 B1 * 9/2001 Pribonic ..... B60L 7/28 187/350
6,645,130 B2 * 11/2003 Webber ..... A63B 21/078 482/104
7,470,220 B2 * 12/2008 Hernandez ..... A63B 21/012 188/25
7,731,635 B2 * 6/2010 Dyer ..... A63B 22/0664 482/52
7,780,577 B2 * 8/2010 Arnold ..... A63B 22/001 482/51
8,585,561 B2 * 11/2013 Watt ..... A63B 21/0051 482/57
8,834,324 B2 * 9/2014 Lull ..... A63B 21/015 482/63
9,278,249 B2 * 3/2016 Watterson ..... A63B 22/0605
9,327,162 B2 * 5/2016 Huang ..... A63B 22/06
9,839,807 B2 * 12/2017 Golesh ..... A63B 21/00069
9,919,182 B2 * 3/2018 Golesh ..... A63B 21/0051
10,112,067 B2 * 10/2018 Golesh ..... A63B 21/0125
10,220,260 B2 * 3/2019 Chang ..... A63B 21/225
2001/0018387 A1 * 8/2001 Webber ..... A63B 21/078 482/142
2007/0179023 A1 * 8/2007 Dyer ..... A63B 22/0664 482/52
2008/0020902 A1 * 1/2008 Arnold ..... A63B 22/001 482/51
2008/0234112 A1 * 9/2008 Hernandez ..... A63B 21/012 482/63
2010/0069205 A1 * 3/2010 Lee ..... A63B 21/0051 482/63
2010/0234185 A1 * 9/2010 Watt ..... A63B 21/0051 482/8
2010/0323850 A1 * 12/2010 Bingham, Jr. ..... A63B 21/225 482/63
2011/0215542 A1 * 9/2011 Wang ..... B62B 3/02 280/35
2012/0088637 A1 * 4/2012 Lull ..... A63B 21/015 482/57
2012/0088638 A1 * 4/2012 Lull ..... A63B 21/015 482/57
2017/0106222 A1 * 4/2017 Mayer ..... F16D 55/2245
2018/0162694 A1 * 6/2018 Hu ..... B66B 5/22

* cited by examiner

RESISTANCE DEVICE AND EXERCISE EQUIPMENT HAVING THE SAME

CROSS-REFERENCE TO RELATED APPLICATION

This application claims priority of Taiwanese Patent Application No. 106209367, filed on Jun. 27, 2017.

FIELD

The disclosure relates to an exercise equipment, and more particularly to an exercise equipment that generates an adjustable torque.

BACKGROUND

In order to maintain the health of an individual, more and more people prefer to do training with exercise equipment rather than take part in outdoor activities. For example, a conventional exercise bike and a conventional spinning exercise device are often used to do muscle training, and both generate torque by rotation of fly wheels.

The conventional exercise equipment includes a resistance member and a torque generating mechanism. When the resistance member comes into contact with the torque generating mechanism, a torque is generated. The magnitude of a resistance which is applied between the resistance member and the torque generating mechanism is adjustable by adjusting the position of the resistance member with an adjuster. However, when a user operates the adjuster to adjust the magnitude of the resistance, the user can only learn of the approximate torque value by individual feelings, and a real value of the torque is not available.

SUMMARY

Therefore, an object of the disclosure is to provide an exercise equipment that can alleviate at least one of the drawbacks of the prior art.

According to the disclosure, the exercise equipment includes a torque generating mechanism and a resistance adjusting mechanism. The torque generating mechanism includes a supporting frame, and a torque generating unit rotatable on the supporting frame, and disposed for generating a torque. The resistance adjusting mechanism includes a resistance device and an adjuster. The resistance device includes a resistance applying unit mounted to the supporting frame and operable to press against the torque generating unit so as to apply a resistance to rotational movement of the torque generating unit, and a resistance sensing unit disposed for sensing the resistance applied by the resistance applying unit. The resistance applying unit includes a fixed seat fixedly mounted to the supporting frame, a contact member pivotally connected to the fixed seat, a first link pivotally connected to the fixed seat, and a second link pivotally connected between the first link and contact member. The fixed seat cooperates with the contact member, the first link and the second link to form a four-bar linkage. The resistance device is convertible between a standby state and a resistance applying state such that, when the resistance device is converted from the standby state to the resistance applying state, the contact member moves toward the torque generating unit. The first and second links are rotatable relative to each other when the resistance device is converted between the standby state and the resistance applying state. The resistance sensing unit includes a magnetic member mounted to the second link and movable relative to the first link, and a Hall sensing module mounted to the first link, and disposed for outputting a sensing signal generated by magnetic field variation induced by a relative movement between the Hall sensing module and the magnetic member. The adjuster is mounted to the supporting frame, is connected to the resistance applying unit, and is operable to deform the four-bar linkage when the resistance device is in the resistance applying state, so as to change the resistance applied by the resistance applying unit.

Therefore, another object of the disclosure is to provide a resistance device that applies a resistance to torque generation of a torque generating mechanism.

According to the disclosure, the resistance device is adapted to apply a resistance to torque generation of a torque generating mechanism. The torque generating mechanism includes a supporting frame, and a torque generating unit rotatable on the supporting frame. The resistance device includes a resistance applying unit and a resistance sensing unit. The resistance applying unit includes a fixed seat fixedly mounted to the supporting frame, a contact member pivotally connected to the fixed seat, a first link pivotally connected to the fixed seat, and a second link pivotally connected between the first link and the contact member. The fixed seat cooperates with the contact member, the first link and the second link to form a four-arm linkage. The resistance device is convertible between a standby state and a resistance applying state such that, when the resistance device is converted from the standby state to the resistance applying state, the contact member moves toward the torque generating unit to apply the resistance. The first and second links are rotatable relative to each other when the resistance device is converted between the standby state and the resistance applying state. The resistance sensing unit includes a magnetic member mounted to the second link, and movable relative to the first link, and a Hall sensing module mounted to the first link, and disposed for outputting a sensing signal generated by magnetic field variation induced by a relative movement between the Hall sensing module and the magnetic member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
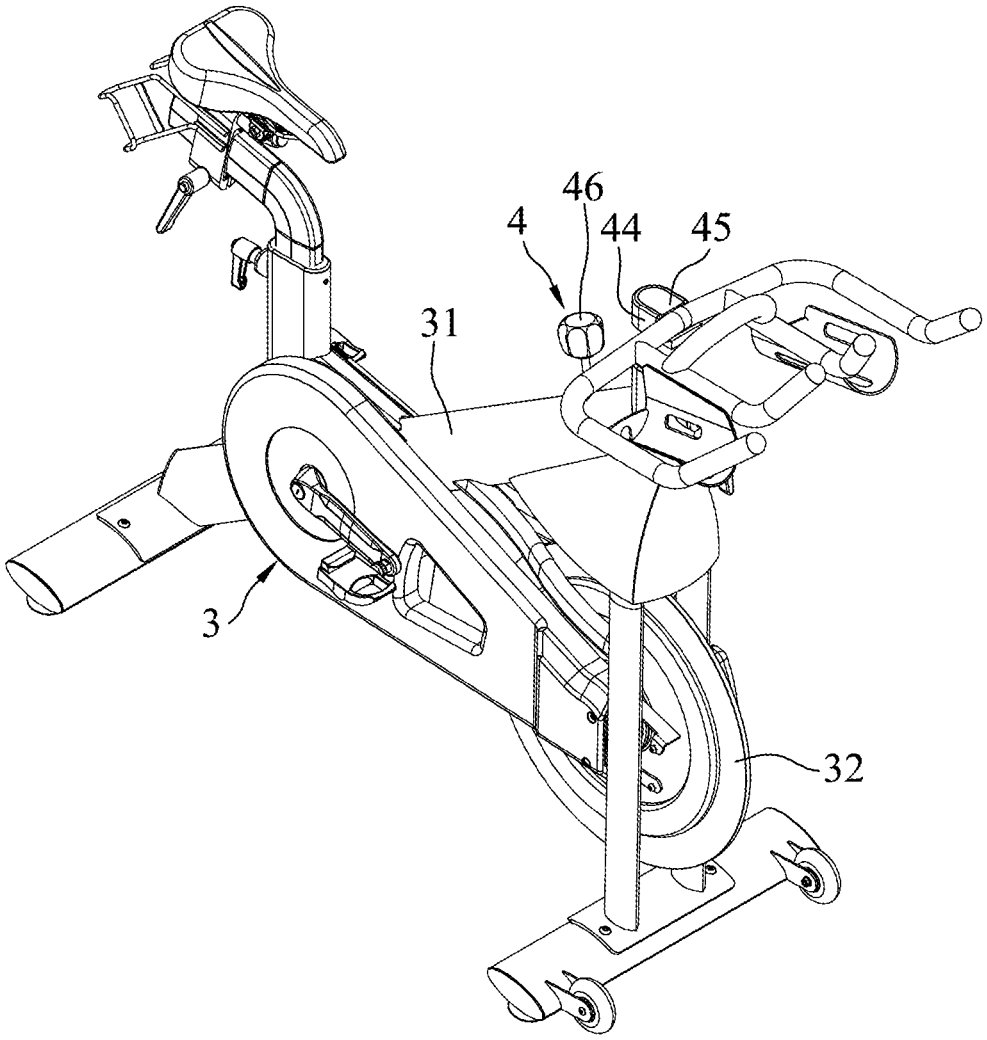
FIG. 1 is a perspective view of an embodiment of an exercise equipment according to the disclosure.
Figure 2:
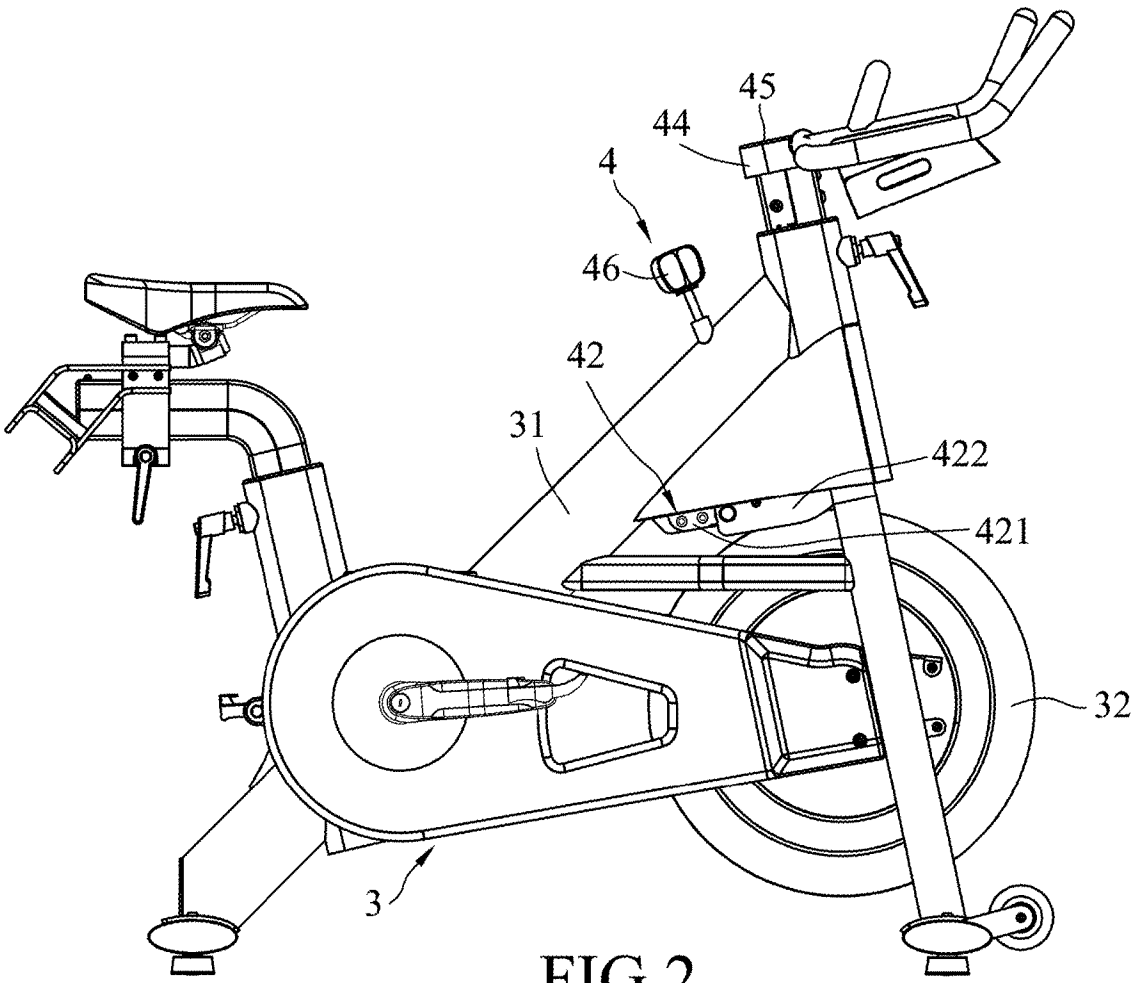
FIG. 2 is a side view of the embodiment.

Referring to FIGS. 1 and 2, the embodiment of an exercise equipment according to the disclosure is adapted to be operated by a user to do training. In this embodiment, the exercise equipment is a spinning exercise device, and in other embodiments, the exercise equipment may be any equipment that can generate a torque such as a row machine, an exercise bike and a stepper, such that the user can training his or her muscle.

The exercise equipment includes a torque generating mechanism 3, and a resistance adjusting mechanism 4 mounted to the torque generating mechanism 3. The torque generating mechanism 3 includes a supporting frame 31, and a torque generating unit 32 mounted to the supporting frame 31, and disposed for generating the torque. In this embodiment, the supporting frame 31 is configured as a frame of the spinning exercise device, and the torque generating unit 32 is configured as a flywheel unit that can generate the torque when the spinning exercise device is operated. It should be noted that, the shapes and the types of the supporting frame 31 and the torque generating unit 32 may be varied in other embodiments.

Figure 3:
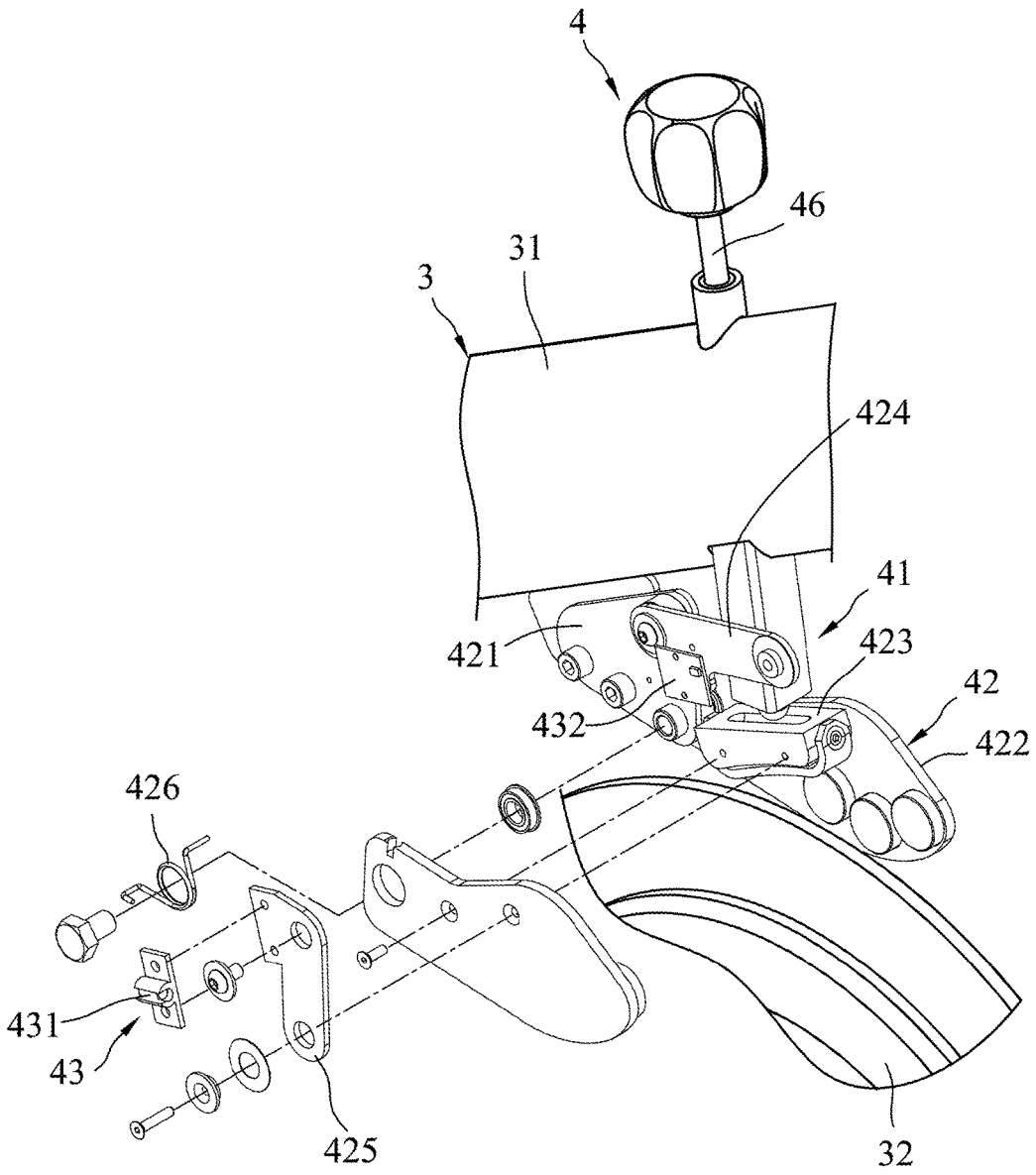
FIG. 3 is a fragmentary and partly exploded perspective view of the embodiment.

Referring to FIGS. 1 and 3, the resistance adjusting mechanism 4 includes a resistance device 41, a torque analyzer 44 connected to the resistance device 41, a screen 45 connected to the torque analyzer 44, and an adjuster 46 mounted to the supporting frame 31 and connected to the resistance device 41.

Figure 4:
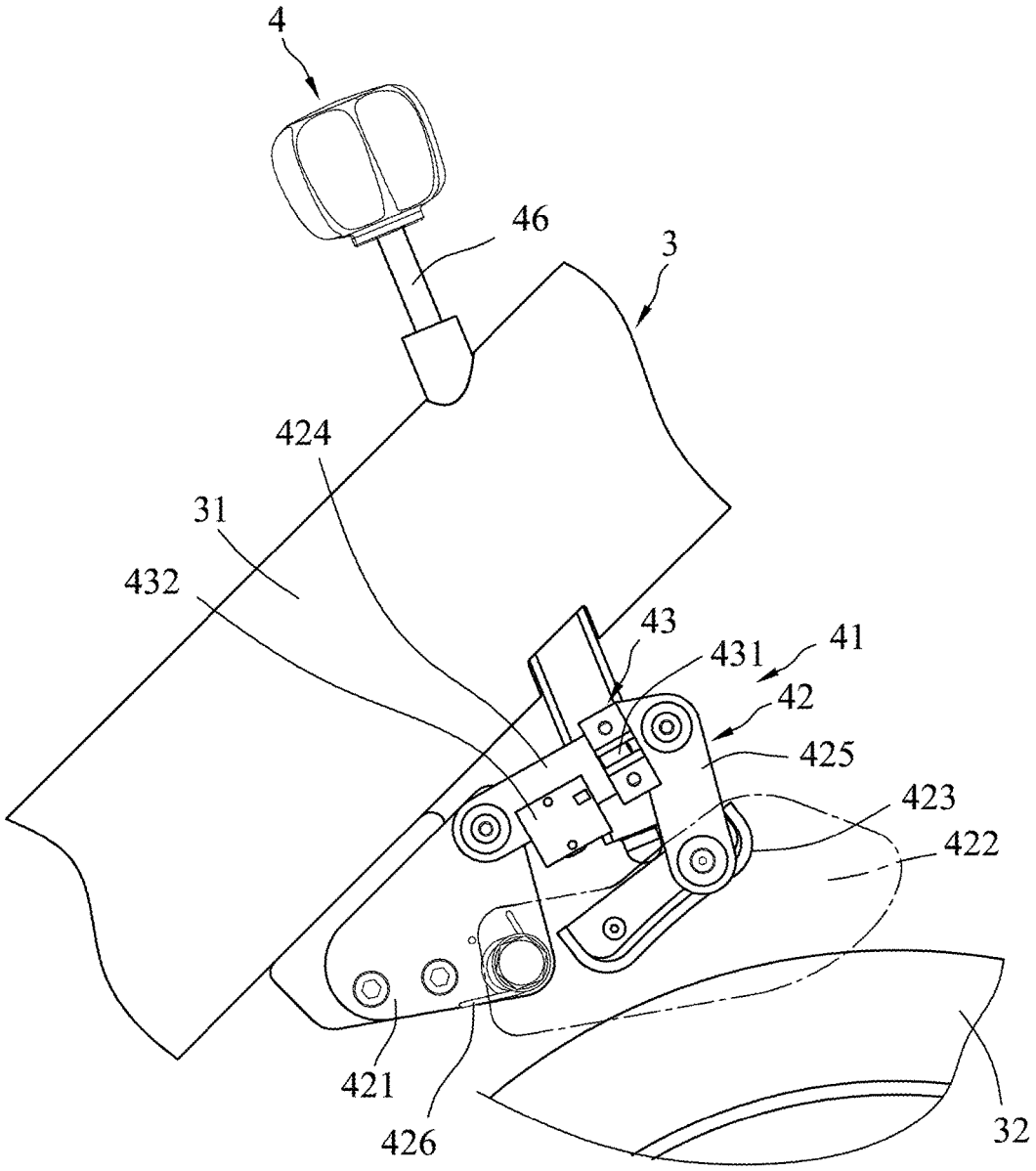
FIG. 4 is a fragmentary side view of the embodiment when a resistance device is in a standby state.
Figure 5:
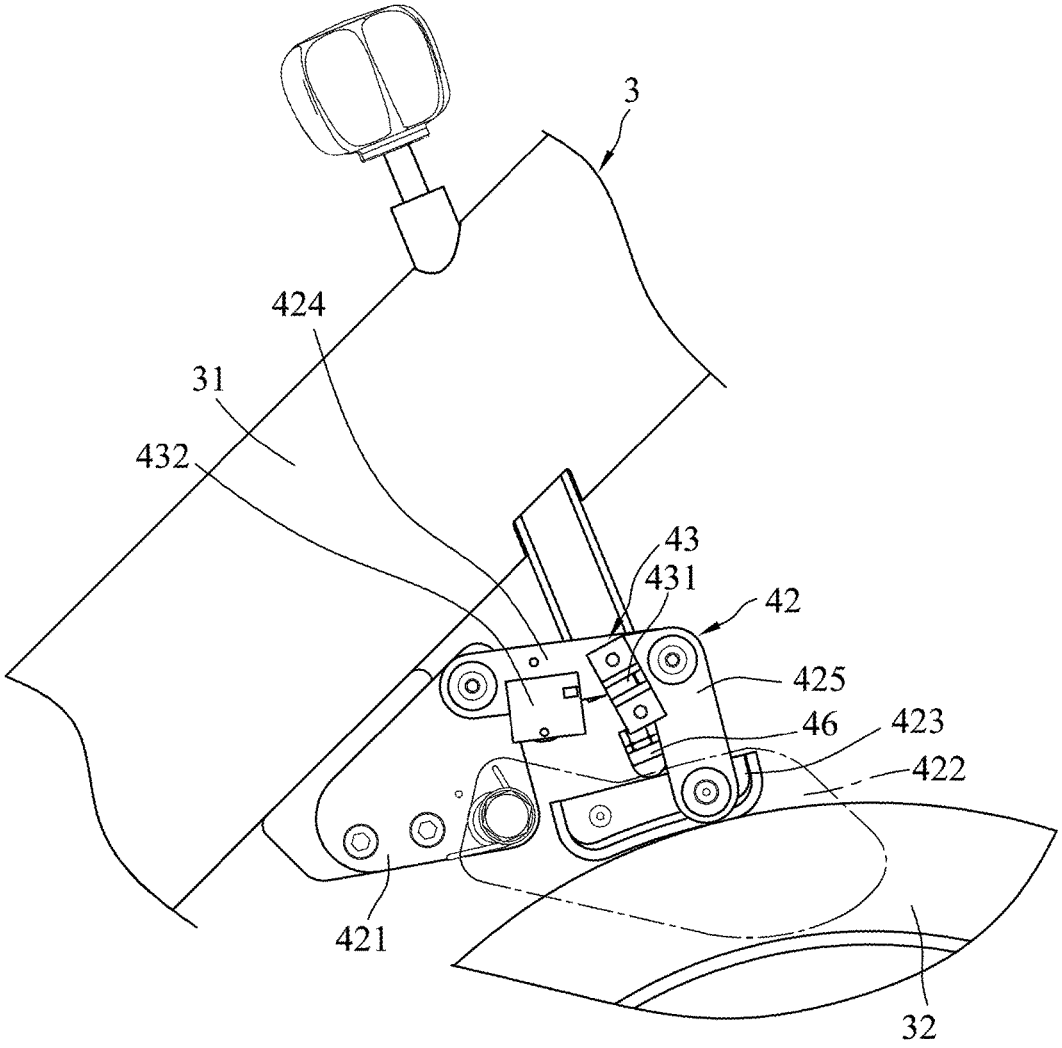
FIG. 5 is a view similar to FIG. 4 but illustrating a resistance applying state of the resistance device.
Figure 6:
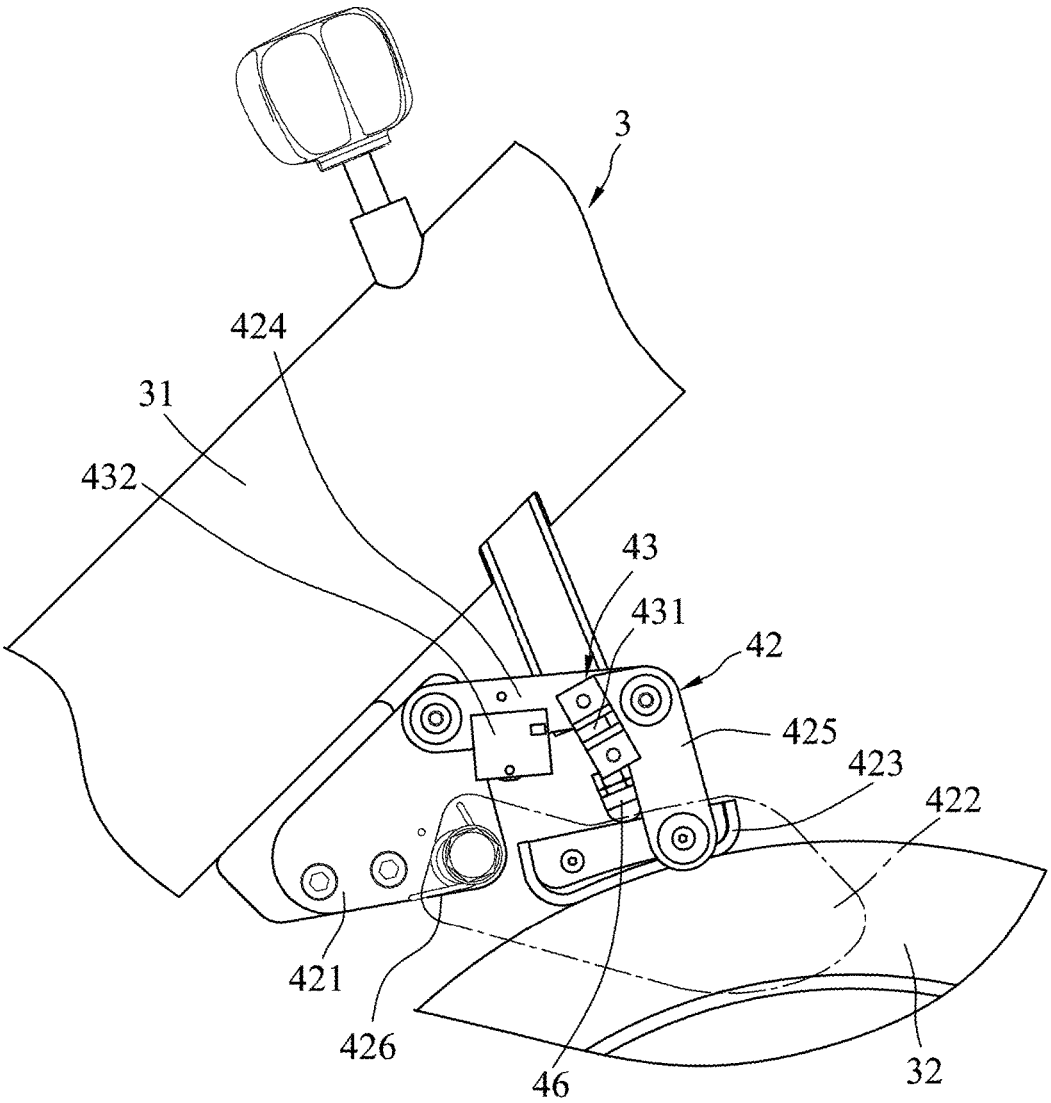
FIG. 6 is a view similar to FIG. 5 but illustrating that, when the resistance device is in the resistance applying state, an adjuster is operated so that the contact member applies a larger resistance.

Referring to FIGS. 3 to 5, the resistance device 41 includes a resistance applying unit 42 mounted to the supporting frame 31 and operable to press against the torque generating unit 32 so as to apply a resistance to rotational movement of the torque generating unit 32, and a resistance sensing unit 43 disposed for sensing the resistance applied by the resistance applying unit 42 to rotational movement of the torque generating unit 32. The resistance applying unit 42 includes a fixed seat 421 fixedly mounted to the supporting frame 31, a contact member 422 pivotally connected to the fixed seat 421, a first link 424 pivotally connected to the fixed seat 421, and a second link 425 pivotally connected between the first link 424 and the contact member 422, and a resilient member 426 mounted between the contact member 422 and the fixed seat 421. The fixed seat 421 cooperates with the contact member 422, the first link 424 and the second link 425 to form a four-bar linkage. The resistance device 41 is convertible between a standby state (see FIG. 4) and a resistance applying state (see FIGS. 5 and 6) such that, when the resistance device 41 is converted from the standby state to the resistance applying state, the contact member 422 moves toward the torque generating unit 32. The first and second links 424, 425 are rotatable relative to each other when the resistance device 41 is converted between the standby state and the resistance applying state. The resilient member 426 is disposed for applying a resilient force to bias the contact member 422 away from the torque generating unit 32.

In this embodiment, the contact member 422 includes a brake 423 made of an elastic material such as a rubber, and is movable to contact the torque generating unit 32 through operation of the adjuster 46, so as to apply the resistance that is a frictional resistance between the brake 423 of the contact member 422 and the torque generating unit 32. When the adjuster 46 is moved from the position of FIG. 5 to the position of FIG. 6, the contact area between the brake 423 and the torque generating unit 32, the frictional resistance applied by the brake 423 to the torque generating unit 32, and the torque generated by the torque generating unit 32 are increased.

In another variation of this embodiment, the contact member 422 is movable to contact the torque generating unit 32 through operation of the adjuster 46, so as to apply the resistance that is a magnetic resistance between the contact member 422 and the torque generating unit 32. It should be note that, the way to apply the resistance between the contact member 422 and the torque generating unit 32 may be varied in other embodiments.

The resistance sensing unit 43 includes a magnetic member 431 mounted to the second link 425 and movable relative to the first link 424, and a Hall sensing module 432 mounted to the first link 424, and disposed for outputting a sensing signal generated by magnetic field variation induced by a relative movement between the Hall sensing module 432 and the magnetic member 431. In other words, the sensing signal is changed when the contact member 422 moves relative to the fixed seat 421. As such, the sensing signal corresponds to the magnitude of the resistance applied between the contact member 422 and the torque generating unit 32. Since the technique that how the Hall sensing module 432 senses the magnetic field variation to output the sensing signal is well-known in the art, details are omitted herein for the sake of brevity.

Referring to FIGS. 1, 4 and 5, the torque analyzer 44 is connected to the resistance sensing unit 43 of the resistance device 41, and is disposed for analyzing the sensing signal received and outputting a corresponding torque value. The screen 45 is mounted to the supporting frame 31, and is disposed for displaying the torque value corresponding to different magnitudes of the resistance. The torque analyzer 44 stores sensing signals corresponding to different distances between the magnetic member 431 and the Hall sensing module 432, and different magnitudes of the resistance applied between the contact member 32 and the torque generating unit 32.

The adjuster 46 has an elongate rod portion extending through the supporting frame 31, and having one end that abuts against the contact member 422 of the resistance applying unit 42 such that the contact member 422 is biased by the resilient member 426 to contact the one end of the adjuster 46, and is operable to move relative to the supporting frame 31 toward or away from the contact member 422, and to deform the four-bar linkage when the resistance device 41 is in the resistance applying state, so as to change the resistance applied by the resistance applying unit 42 to the rotational movement of the torque generating unit 32. In another variation of the embodiment, the adjuster 46 may drive other members of the resistance applying unit 42 to move the contact member 422 toward or away from the torque generating unit 32. In other words, in other embodiments, the adjuster 46 may abut against the four-bar linkage of the resistance applying unit 42, and can be moved to drive the contact member 422 to move toward the torque generating unit 32. Since the different types of the adjuster 46 are well-known in the art, details are omitted herein for the sake of brevity.

Referring to FIGS. 1, and 4 to 6, during operation, when the user desires to increase the torque value, it is necessary to operate the adjuster 46 to move the contact member 422 toward the torque generating unit 32 so as to increase the contact area between the brake 423 and the torque generating unit 32. During such operation of the adjuster 46, when the torque analyzer 44 receives a sensing signal that corresponds to a certain distance between the magnetic member 431 and the Hall sensing module 432, it transfers the sensing signal to a corresponding resistance applied between the contact member 422 and the torque generating unit 32, and the corresponding resistance is then transferred to a corresponding torque value. The corresponding torque value is subsequently displayed on the screen 45. When the user desires to decrease the torque value, it is necessary to operate the adjuster 46. When the contact member 422 separates from the adjuster 46, the resilient member 426 moves the contact member 422 into contact with the adjuster 46.

In conclusion, with the configuration of the exercise equipment, the user can instantly acquire the torque value at that time. Furthermore, since the structure of the resistance device 41 is simple, the manufacture and assembly of the exercise equipment are convenient.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An exercise equipment comprising:

a torque generating mechanism including a supporting frame, and a torque generating unit that is mounted to said supporting frame, and that is rotatable on said supporting frame for generating a torque; and a resistance adjusting mechanism including a resistance device and an adjuster, said resistance device including a resistance applying unit that is mounted to said supporting frame and that is operable to press against said torque generating unit so as to apply a resistance to rotational movement of said torque generating unit, and a resistance sensing unit that is disposed for sensing the resistance applied by said resistance applying unit, said resistance applying unit including a fixed seat that is fixedly mounted to said supporting frame, a contact member that is pivotally connected to said fixed seat, a first link that is pivotally connected to said fixed seat, and a second link that is pivotally connected between said first link and said contact member, said fixed seat cooperating with said contact member, said first link and said second link to forma four-bar linkage, said resistance device being convertible between a standby state and a resistance applying state such that, when said resistance device is converted from the standby state to the resistance applying state, said contact member moves toward said torque generating unit, said first and second links being rotatable relative to each other when said resistance device is converted between the standby state and the resistance applying state, said resistance sensing unit including a magnetic member that is mounted to said second link and that is movable relative to said first link, and a Hall sensing module that is mounted to said first link, and that is disposed for outputting a sensing signal generated by magnetic field variation induced by a relative movement between said Hall sensing module and said magnetic member, said adjuster being mounted to said supporting frame, being connected to said resistance applying unit, and being operable to deform said four-bar linkage when said resistance device is in the resistance applying state, so as to change the resistance applied by said resistance applying unit.

2. The exercise equipment as claimed in claim 1, wherein said resistance applying unit further includes a resilient member mounted between said contact member and said fixed seat, and disposed for applying a resilient force to bias said contact member away from said torque generating unit.

3. The exercise equipment as claimed in claim 2, wherein said adjuster has an elongate rod portion extending through said supporting frame, having one end that abuts against said contact member such that said contact member is biased by said resilient member to contact said one end of said adjuster, and operable to move relative to said supporting frame toward or away from said contact member.

4. The exercise equipment as claimed in claim 3, wherein said contact member is movable to contact said torque generating unit through operation of said adjuster, so as to apply the resistance that is a frictional resistance between said contact member and said torque generating unit.

5. The exercise equipment as claimed in claim 3, wherein said contact member is movable to contact said torque generating unit through operation of said adjuster, so as to apply the resistance that is a magnetic resistance between said contact member and said torque generating unit.

6. The exercise equipment as claimed in claim 1, wherein said torque adjusting mechanism further includes a torque analyzer connected to said resistance sensing unit, and disposed for analyzing the sensing signal received and outputting a corresponding torque value, and a screen mounted to said supporting frame, and connected to said torque analyzer for displaying the torque value.

7. A resistance device adapted to apply a resistance to torque generation of a torque generating mechanism, the torque generating mechanism including a supporting frame, and a torque generating unit that is rotatable on the supporting frame, said resistance device comprising:

a resistance applying unit including a fixed seat that is fixedly mounted to the supporting frame, a contact member that is pivotally connected to said fixed seat, a first link that is pivotally connected to said fixed seat, and a second link that is pivotally connected between said first link and said contact member, said fixed seat cooperating with said contact member, said first link and said second link to forma four-arm linkage, said resistance device being convertible between a standby state and a resistance applying state such that, when said resistance device is converted from the standby state to the resistance applying state, said contact member moves toward said torque generating unit to apply the resistance, said first and second links being rotatable relative to each other when said resistance device is converted between the standby state and the resistance applying state; and a resistance sensing unit including a magnetic member that is mounted to said second link, and that is movable relative to said first link, and a Hall sensing module that is mounted to said first link, and that is disposed for outputting a sensing signal generated by magnetic field variation induced by a relative movement between said Hall sensing module and said magnetic member.

8. The resistance device as claimed in claim 7, wherein said resistance applying unit further includes a resilient member mounted between said contact member and said fixed seat, and disposed for applying a resilient force to bias said contact member away from said torque generating unit.

9. The resistance device as claimed in claim 7, wherein said contact member is movable to contact said torque generating unit through operation of said adjuster, so at to apply the resistance that is a frictional resistance between said contact member and said torque generating unit.

10. The resistance device as claimed in claim 7, wherein said contact member is movable to contact said torque generating unit through operation of said adjuster, so as to apply the resistance that is a magnetic resistance between said contact member and said torque generating unit.

* * * * *